United States Patent [19]

Sheth

[11] Patent Number: 4,838,758

[45] Date of Patent: Jun. 13, 1989

[54] REDUCED DIAMETER DOWNTHRUST PAD FOR A CENTRIFUGAL PUMP

[75] Inventor: Ketankumar K. Sheth, Tulsa, Okla.

[73] Assignee: Baker Hughes Incorporated, Houston, Tex.

[21] Appl. No.: 138,628

[22] Filed: Dec. 28, 1987

[51] Int. Cl.[4] ..... F04D 29/04

[52] U.S. Cl. ..... 415/140; 415/199.2; 415/901

[58] Field of Search ..... 415/104, 106, 131, 132, 415/140, 170 A, 170 R, 199.1, 199.2, 199.3, 501

[56] References Cited

U.S. PATENT DOCUMENTS

| | | | |
|---|---|---|---|
| 1,655,030 | 1/1928 | White | 415/199.1 X |
| 2,775,945 | 1/1957 | Arutunoff | 415/199.2 X |
| 3,116,696 | 1/1964 | Deters | 415/140 |
| 3,265,001 | 8/1966 | Deters | 415/199.3 X |
| 3,361,073 | 1/1968 | Medgyesy | 415/199.2 X |
| 3,612,716 | 10/1971 | Deters | 415/140 |
| 4,741,668 | 5/1988 | Bearden | 415/212 R |

FOREIGN PATENT DOCUMENTS

| | | | |
|---|---|---|---|
| 626869 | 3/1936 | Fed. Rep. of Germany | 415/104 |

*Primary Examiner*—Edward K. Look
*Assistant Examiner*—Joseph M. Pitko
*Attorney, Agent, or Firm*—James E. Bradley

[57] ABSTRACT

A submersible centrifugal pump has a downward thrust washer of reduced diameter. The pump has a housing containing a plurality of stages of impellers and diffusers. Each impeller is rotated by a shaft for discharging fluid upward and outward into an intake of a diffuser. A counterbore is formed in the upper end of a bore that passes axially through the diffuser. An upward facing shoulder is located at the lower end of the counterbore. A thrust washer is located on the shoulder. An extension sleeve extends downward from the hub of each impeller into the counterbore of the diffuser of a next lower stage. Downward thrust on the impeller is transmitted through the extension sleeve to the thrust washer.

4 Claims, 2 Drawing Sheets

REDUCED DIAMETER DOWNTHRUST PAD FOR A CENTRIFUGAL PUMP

BACKGROUND OF THE INVENTION

1. Field of the Invention:

This invention relates in general to centrifugal submersible pumps, and in particular to the means for conveying downward thrust on an impeller.

2. Description of the Prior Art

Submersible centrifugal pumps are used for pumping large volumes of fluid from oil wells. The pump assembly has a downhole electric motor that rotates a shaft extending through the pump. A plurality of pump stages extend through a tubular housing of the pump. Each pump stage has a stationary diffuser and an impeller that is mounted to the shaft for rotation.

In a mixed flow type, the impeller passages discharge upward and outward. The downward thrust on the impellers which occurs as a result of the fluid being discharged is conveyed to the diffuser through a thrust pad or thrust washer. The thrust washer is located on a shoulder of the diffuser that is outward of the intake of the impeller passages. A downward facing shoulder on each impeller contacts the thrust washer.

While this is successful, the downward thrust washer has a relatively large diameter because of its location. The large surface area of the downward thrust washer results in more friction being produced than if the diameter is smaller.

SUMMARY OF THE INVENTION

In this invention, the contact area of the downward thrust washer is reduced greatly. The downward thrust washer is located radially inward of the diffuser passages. Preferably, the downward thrust washer is located on a shoulder in a counterbore formed in the diffuser. An extension sleeve extends downward from the hub of the impeller. The extension sleeve contacts the thrust washer to transmit downward thrust on the impeller to the thrust washer.

DESCRIPTION OF THE PREFERRED EMBODIMENT

Figure 2:
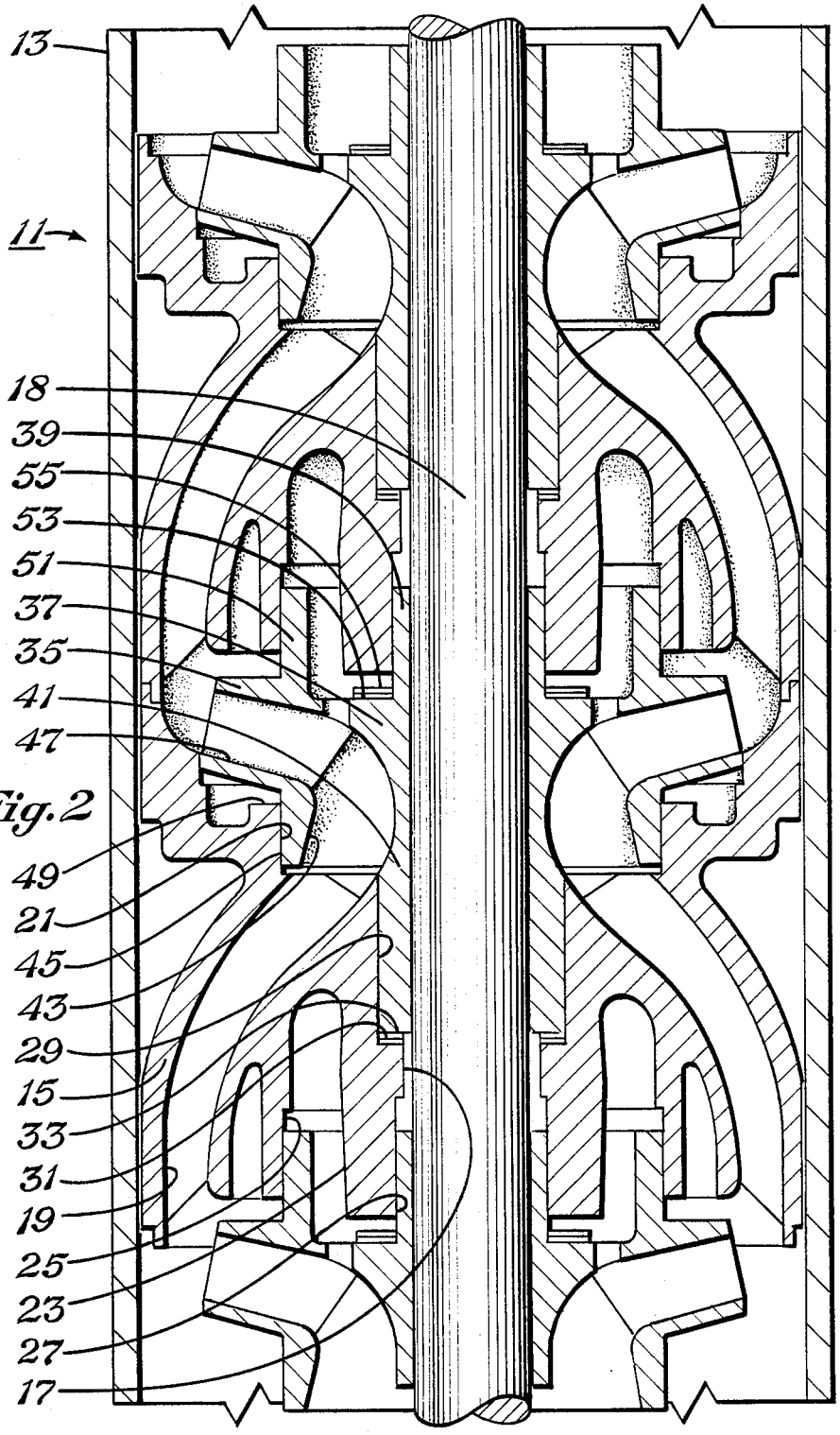
FIG. 2 is a partial, vertical sectional view of a mixed flow centrifugal pump constructed in accordance with this invention.

Referring to FIG. 2, pump 11 has a tubular housing 13. A plurality of diffusers 15 are stationarily mounted in the housing 13. Each diffuser 15 joins adjacent diffusers on the upper and lower end. Each diffuser 15 has an axial bore 17 through which passes a drive shaft 18. A plurality of passages 19 lead from a lower inlet to an upper annular outlet 21. The outlet 21 has an outer diameter that is less than the outer diameter of the inlet to the passages 19. The outlet 21 is a single, annular opening into which each of the passages 19 terminate.

An annular recess 23 is formed in the diffuser 15. The recess 23 is located outward of the bore 17 and inward of the passages 19. The recess 23 opens downward. A balance wall 25 defines the outer periphery of the recess 23.

A lower counterbore 27 is formed in the lower end of the bore 17. The lower counterbore 27 extends upward a distance less than half the length of the bore 17. An upper counterbore 29 extends downward from the top of the diffuser 15. The upper counterbore 29 is larger in diameter than the counterbore 27. The upper counterbore 29 terminates in an upward facing shoulder 31. The length of the upper counterbore 29 is slightly less than half the length of the bore 17.

A thrust washer or thrust pad 33 of conventional material is located on the shoulder 31. Thrust washer 33 is located radially inward of the passages 19. The outer diameter of thrust washer 33 is less than the outer diameter of the diffuser outlet 21.

An impeller 35 cooperates with each diffuser 15. Impeller 35 has an integrally formed hub 37. Hub 37 is connected to the shaft 18 by a key (not shown). The key causes the impeller 35 to rotate with the shaft 18, but allows axial movement of the impeller 35 relative to the shaft 18.

Hub 37 has an upper section 39 that extends into the lower counterbore 27 of the diffuser 15. Upper section 39 is in rotating and in sliding engagement with the lower counterbore 27. The upper end of the hub upper section 39 terminates below the upper end of the lower counterbore 27.

An extension sleeve 41 extends downward from hub 37. Extension sleeve 41 in the preferred embodiment is integrally connected to hub 37. Extension sleeve 41 thus rotates with the shaft 18. Extension sleeve 41 extends downward into the upper counterbore 29 of the diffuser 15 of the next lower stage. The sidewall of the extension sleeve 41 engages the upper counterbore 29 in rotating and sliding contact. The lower end of extension sleeve 41 contacts the thrust washer 33. The upper end of the extension sleeve 41 contacts the lower end of the hub 37. Extension sleeve 41 serves as means for engaging the hub 37 with the thrust washer 33 to convey downward thrust.

Each impeller 35 has a circular intake 43. A circular skirt 45 encircles the intake 43. The outer wall of the skirt 45 engages the diffuser outlet 21 in the next lower stage in rotating sliding contact. Each impeller 35 is a mixed flow type, discharging fluid in both an upward and outward direction. A plurality of passages 47 extend upward and outward from the intake 43 for discharging the fluid. Each passage 47 also curves in the direction opposite that of rotation. The lower side of each impeller 35 outward of skirt 45 is spaced above a diffuser outer shoulder 49 of the next lower stage by a clearance.

A balance ring 51 is formed on the upper side of each impeller 35. The balance ring 51 extends into the diffuser recess 23. The outer wall of the balance ring 51 engages the balance wall 25 in rotating and sliding contact. Each impeller 35 has an upper shoulder 53 which is located immediately radially outward from the hub upper section 39. An upper thrust washer 55 is located on the upper shoulder 53.

In operation, shaft 18 is rotated. This rotates the impellers 35. Fluid is discharged from the impeller passages 47 into the diffuser passages 19. The fluid flows upward and inward through passages 19 to the intake 43 of the next upward impeller 35. A downward force is created by the discharge of fluid in the upward direction. This force causes the impellers 35 to tend to move downward on the shaft 18.

The downward thrust is transmitted by the hub 37 through the extension sleeve 41 and to the thrust washer 33. The thrust is transmitted through the thrust washer 33 to the diffuser 15 of the next lower stage. Any upward thrust on the impellers 35 is handled by the thrust washer 55 which contacts the lower end of the diffuser 15.

Figure 1:
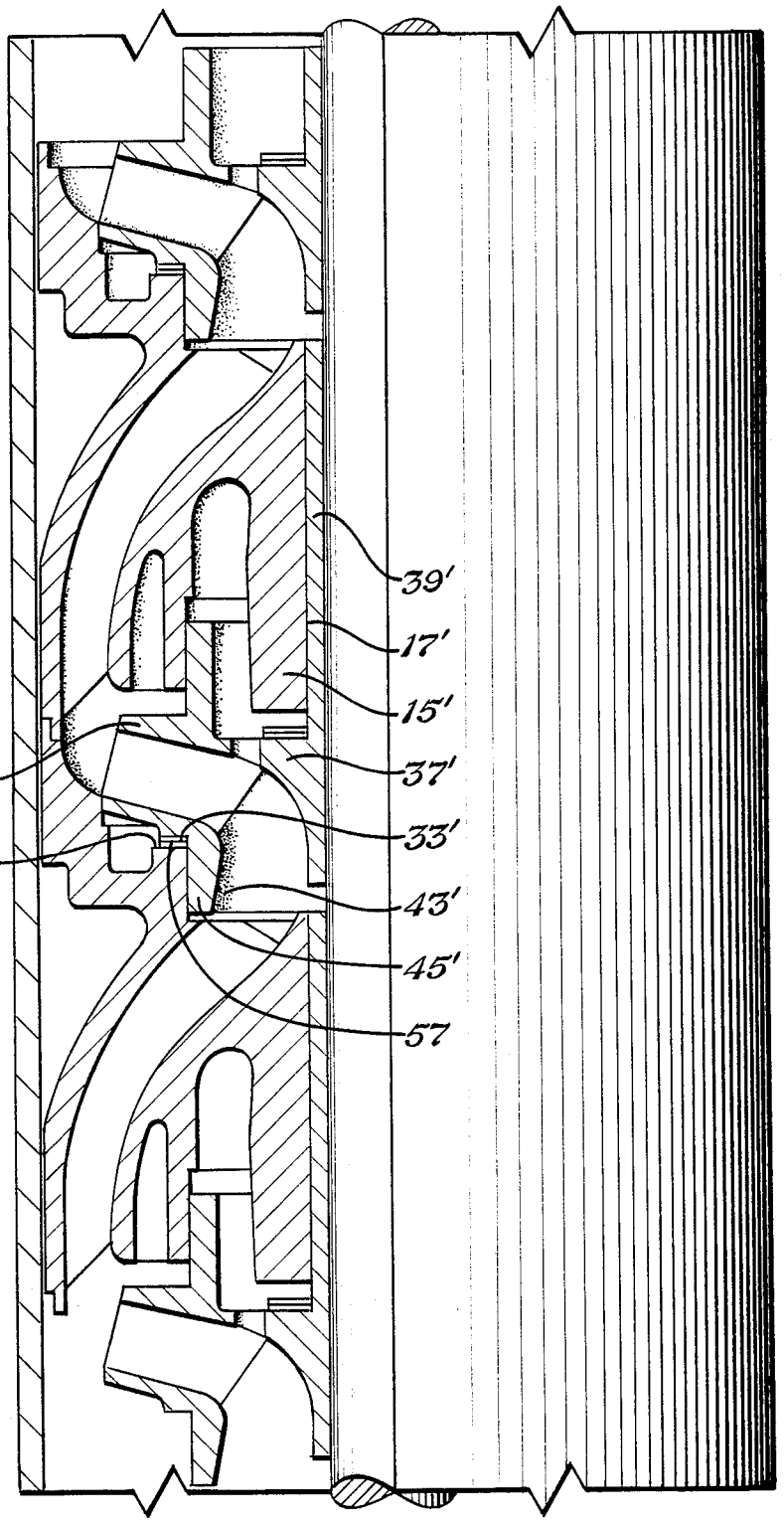
Fig. 1 (PRIOR ART)
FIG. 1 is a vertical, partial sectional view of a prior art mixed flow centrifugal submersible pump.

Referring to FIG. 1, a prior art pump is shown. Each impeller 35' has a hub upper section 39' that extends completely through the bore 17'. There are no counterbore sections in the bore 17'. The downward thrust washer 33' is located on the outer shoulder 49'. The inner diameter of the thrust washer 33' is greater than the outer diameter of the outlet of the diffuser 15'.

A downward facing shoulder 57 is formed on the impeller 35' outward of the impeller intake 43'. The hub 37' has a lower end that is spaced above the lower end of the skirt 45'. All downward thrust is handled by the thrust washer 33' and shoulders 49' and 57. Downward thrust is not transmitted through the hub 37'.

The invention has significant advantages. The downward thrust washer is considerably smaller in diameter than the prior art downward thrust washer. This results in a smaller surface area and thus less friction being created due to downward thrust. This lowers the torque requirements needed to overcome the friction, thus making the pump more efficient. Also, the location of the downward thrust washer in the counterbore places it in a better position from contact with abrasive fluids.

While the invention has been shown in only one of its forms, it should be apparent to those skilled in the art that it is not so limited, but is susceptible to various changes without departing from the scope of the invention.

I claim:

1. In a submersible centrifugal pump having a housing containing a plurality of stages, a driven shaft extending through the housing, each stage having an impeller with a central hub mounted to the shaft for rotation therewith, the impeller having an intake on its lower side for a plurality of passages which incline upward and outward for discharging fluid to a stationary diffuser having a central bore an a plurality of passages leading upward and inward to an annular outlet, the hub having an upper section which is rotatably received inside the bore, the improvement comprising:

an upward facing thrust shoulder located in the bore of each diffuser, the thrust shoulder having an outer diameter less than the outer diameter of the diffuser outlet and being recessed below an upper end of the diffuser, defining a cylindrical wall surface within the bore above the thrust shoulder; and means including an extension sleeve extending downward from the hub of each impeller for engaging the hub of each impeller with the thrust shoulder of a next lower stage for transmitting downward thrust, the extension sleeve being rotatable with the impeller of the next upward stage and engaging the cylindrical wall surface in sliding rotating contact.

2. In a submersible centrifugal pump having a housing containing a plurality of stages, a driven shaft extending through the housing, each stage having an impeller with a central hub mounted to the shaft for rotation therewith, the impeller having an intake on its lower side for a plurality of passages which incline upward and outward for discharging fluid to a stationary diffuser having a central bore and a plurality of passages leading upward and inward, the hub having an upper section which is rotatably received inside the bore, the improvement comprising:

a counterbore formed in an upper end of the bore of each diffuser, defining an upward facing thrust shoulder at the lower end of the counterbore;

an extension sleeve extending downward from the hub of each impeller into engagement with the thrust shoulder of the diffuser of a next lower stage for transmitting downward thrust, the extension sleeve being rotatable with the impeller of the next upward stage.

3. In a submersible centrifugal pump having a housing containing a plurality of stages, a driven shaft extending through the housing, each stage having an impeller with a central hub mounted to the shaft for rotation therewith, the impeller having an intake on its lower side for a plurality of passages which lead upward and outward to a stationary diffuser having a central bore and a plurality of passages leading upward and inward, the hub having an upper section which is rotatably received inside the bore, the improvement comprising in combination:

a counterbore formed in an upper end of the bore of each diffuser, defining an upward facing shoulder at the lower end of the counterbore;

a thrust pad located on the shoulder; and an extension sleeve integrally formed with and extending downward from the hub of each impeller into the counterbore of the diffuser of a next lower stage in contact with the thrust pad for transmitting downward thrust.

4. A submersible centrifugal pump, comprising in combination:

a tubular housing;

a rotatable shaft extending axially through the housing;

a plurality of diffusers mounted stationarily inside the housing, each diffuser having a plurality of passages leading upward and inward to a circular outlet, each diffuser having a bore through which the shaft passes, each diffuser having an annular recess on its lower end spaced outward from the bore and defining a supporting wall;

a plurality of impellers, each having a lower intake leading to a plurality of passages which extend upward and outward;

a central hub on each impeller mounted to the shaft for rotation therewith but movable relative to the shaft in axial directions;

the hub having an upper section which extends into the bore in rotating sliding engagement with the bore;

a cylindrical skirt on the lower side of the impeller outward of the impeller intake which extends downward in rotating sliding engagement with the outlet of the diffuser of a next lower stage;

a balance ring extending upward from the impeller into the annular recess of the diffuser in rotating sliding engagement with the balance wall;

a counterbore formed in an upper end of the bore, defining an upward facing shoulder at the lower end of the counterbore, the shoulder being located above the upper end of the upper section of the hub of the impeller;

a thrust pad located on the shoulder; and an extension sleeve extending downward from the hub of each impeller into the counterbore of the diffuser of the next lower stage into contact with the thrust pad for transmitting downward thrust on the impeller to the thrust pad, the extension sleeve being rotatable with the impeller and contacting the bore in rotating sliding engagement.

* * * * *